US008900530B2

(12) United States Patent
Wang et al.

(10) Patent No.: US 8,900,530 B2
(45) Date of Patent: Dec. 2, 2014

(54) MICRO-VOLUME LIQUID EJECTION SYSTEM

(75) Inventors: Dong Wang, Beijing (CN); Kun Zou, Beijing (CN); Jianxing Ye, Beijing (CN); Yelei Sun, Beijing (CN); Hui Zhu, Beijing (CN); Xianhua Wang, Beijing (CN); Jing Cheng, Beijing (CN)

(73) Assignees: CapitalBio Corporation, Beijing (CN); Tsinghua University, Beijing (CN)

( * ) Notice: Subject to any disclaimer, the term of this patent is extended or adjusted under 35 U.S.C. 154(b) by 1712 days.

(21) Appl. No.: 11/666,032

(22) PCT Filed: Nov. 22, 2004

(86) PCT No.: PCT/CN2004/001331

§ 371 (c)(1),
(2), (4) Date: Jun. 19, 2008

(87) PCT Pub. No.: WO2006/045229

PCT Pub. Date: May 4, 2006

(65) Prior Publication Data

US 2008/0267828 A1 Oct. 30, 2008

(30) Foreign Application Priority Data

Oct. 28, 2004 (CN) ..... 2004 1 0086248

(51) Int. Cl.
*B01L 3/02* (2006.01)

(52) U.S. Cl.
CPC ..... *B01L 3/0265* (2013.01); *B01L 2400/0666* (2013.01); *B01L 2400/0487* (2013.01)
USPC ..... 422/504; 422/501; 422/505

(58) Field of Classification Search
USPC ..... 422/501, 504–505
See application file for complete search history.

(56) References Cited

U.S. PATENT DOCUMENTS 4,241,750 A * 12/1980 Furuse et al. ..... 137/101.19
5,158,748 A * 10/1992 Obi et al. ..... 422/511
5,456,880 A * 10/1995 Miura ..... 422/509

(Continued)

FOREIGN PATENT DOCUMENTS

CN 1286691 3/2001
CN 1373687 10/2002

(Continued)

OTHER PUBLICATIONS

International Preliminary Report on Patentability for PCT/CN2004/001331, issued on Dec. 24, 2007, 4 pages.

(Continued)

*Primary Examiner* — Jan Ludlow
(74) *Attorney, Agent, or Firm* — Morrison & Foerster LLP

(57) ABSTRACT

The present invention relates to a micro-volume liquid ejection system, including an air pressure module, a micro-ejection unit which is connected with the air pressure module by a conduit, and a control circuit which is connected with the air pressure module and the micro-ejection unit respectively. The air is used as the pressure medium, resulting in improved cleaning process and reduced sample waste. The present invention includes an electric control circuit to pick up sample, eject sample and clean the conduits automatically, and enables handling of a multiplicity of samples. The present invention can be used for transferring or dispensing micro volume liquid including biological liquid on a nL and μL scale.

4 Claims, 4 Drawing Sheets

FIG. 1

(56) References Cited

U.S. PATENT DOCUMENTS

| | | | | |
|---|---|---|---|---|
| 6,521,187 | B1 * | 2/2003 | Papen | 422/504 |
| 7,470,547 | B2 * | 12/2008 | Tisone et al. | 436/180 |
| 7,527,768 | B2 * | 5/2009 | Ikushima | 422/100 |
| 2002/0095240 | A1 | 7/2002 | Sickinger et al. | |
| 2002/0149864 | A1 | 10/2002 | Kaneko | |
| 2006/0225786 | A1 * | 10/2006 | Kucera et al. | 137/209 |

FOREIGN PATENT DOCUMENTS

| | | |
|---|---|---|
| JP | 59-168336 | 9/1984 |
| JP | 61-091704 | 5/1986 |
| JP | 62-201811 | 9/1987 |
| JP | 10-090281 | 4/1998 |
| JP | 2002-311213 | 10/2002 |
| JP | 2003-121452 | 4/2003 |
| JP | 2003-315351 | 11/2003 |
| JP | 2004-089849 | 3/2004 |
| SU | 462589 | 6/1975 |

OTHER PUBLICATIONS

International Search Report for PCT/CN2004/001331, mailed on Aug. 4, 2005, 3 pages.

Office Action from Japanese Patent Application No. 2007-538240, mailed on Oct. 13, 2009.

* cited by examiner

MICRO-VOLUME LIQUID EJECTION SYSTEM

TECHNICAL FIELD

The present invention relates to a liquid ejection system, and more particularly to a micro-volume liquid ejection system featured with pneumatic drive and micro valve control.

BACKGROUND ART

Three types of technologies are currently used for fabricating microarray biochip: in situ synthesis, contact printing with spotting pins, and non-contact dispensing. Among these technologies, in situ synthesis can only be used to fabricate oligonucleotide microarrays. Contact printing with spotting pins is very simple and easily implemented; and thus, it is the most widely used technology nowadays. However, the sample volume printed for each spot depends on the physical dimensions of the spotting pins which are difficult to control, and reproducibility of the printed sample fluid volume is low. Non contact dispensing techniques provide control to fluid delivery volume and reproducibility is good as compared to contact printing with spotting pins. There is no need of contact between the dispenser and the substrate; and thus, printing speed can be much faster.

There are three types of non contact dispensing techniques, sorted according to mechanisms: microvalve control, piezoelectric jet, and thermal bubble jet. The key components for microvalve based dispensing technique include a syringe pump and a solenoid operated microvalve, such as BioJet Plus™ series developed by BioDot Company. The syringe pump is used to maintain the pressure inside the tubing between the pump and solenoid microvalve, and to aspirate sample fluid into the apparatus. Under a certain magnitude of pressure, a certain amount of fluid could be ejected through the nozzle by opening the microvalve for a certain period of time. The BioJet Plus™ series dispensers can work in two modes. In one mode, sample fluid is aspirated into the syringe, and the syringe is pushed to fill the tubing connected to the microvalve. A relative large sample volume is required, additional routine maintenance becomes necessary when changing between samples and washing the conduits. In the other mode, the conduits are filled with a certain volume of system fluid before sample fluid is actually aspirated in. The requirement on the sample fluid volume is reduced, but diffusion may be introduced on the interface between system fluid and sample fluid; and thus, it is difficult to recollect samples left. The solenoid microvalve is used to control dispensing volume. The disadvantage of BioJet Plus™ series includes: relative large sample volume or inevitable sample waste; high cost imposed by high precision syringe pump to adjust pressure; difficulty in washing due to the full filled conduit, especially under continual ejection mode; and during dispensing operation, the need to continuously propel the syringe in precise displacement to maintain pressure, and to tune the displacement finely to the decrease of the liquid volume in the conduit for constant pressure output.

SUMMARY OF THE INVENTION

A main objective of the present invention is to provide a micro-volume liquid ejection system, which is easy to operate, uses small volume of samples, and the dispensing volume is controlled easily.

In order to achieve the objective, the present invention uses the following technical design, a micro-volume liquid ejection system comprises: a pneumatic module as the pressure source, a micro-dispensing unit connected to said pneumatic module via a conduit, and a circuit for controlling said pneumatic module and said micro-dispensing unit.

Said micro-dispensing unit may comprise a solenoid electromagnetic microvalve, and a micro-dispenser connected to said microvalve via a conduit or a threaded connection.

Said dispensing unit may be mounted on a robotic arm.

Said pneumatic module may comprise: a pressure delivery conduit; a pneumatic pressure generating unit connected to inlet of said pressure conduit; a pressure sensor unit and a pressure adjusting unit which are connected to the pressure delivery conduit sequentially; an electromagnetic valve connected to the outlet of the pressure delivery conduit and the solenoid microvalve of the micro-dispensing unit.

Said pneumatic pressure generating unit may comprise two parallel electromagnetic valves connected to the inlet of said pressure delivery conduit, an air compressor and a vacuum pump connected to said valves respectively; said pressure sensor unit may comprise two electromagnetic valves connected to the pressure delivery conduit, and a positive pressure sensor and a negative pressure sensor connected to said two electromagnetic valves respectively; said pressure adjusting unit may comprise two parallel electromagnetic valves connected to the pressure delivery conduit, and two pressure regulating valves connected to said electromagnetic valves respectively.

Said pneumatic pressure generating unit may comprise an air compressor, two parallel electromagnetic valves connected to the outlet of said air compressor, a vacuum generator and an additional electromagnetic valve in tandem between one of the two parallel electromagnetic valves and the inlet of the pressure delivery conduit; said pressure sensor unit may comprise two parallel electromagnetic valves connected to the pressure delivery conduit, a positive pressure sensor and a negative pressure sensor connected to said two electromagnetic valves respectively; said pressure adjusting unit may comprise two parallel electromagnetic valves connected to the pressure delivery conduit, and two pressure regulating valves connected to said electromagnetic valves respectively.

Said pneumatic module may comprise a step motor, a linear motion unit with lead screw connected to the outlet of the step motor, a syringe with a plunger linked to the linear motion unit; a pneumatic delivery conduit with one end connected to the outlet of said syringe and the other end connected to said solenoid electromagnetic valve of said micro-dispensing unit; and a positive/negative pressure sensor connected to the pressure delivery conduit.

Said control circuit may comprise a computer, a micro control unit (MCU) communicating with the computer via a serial port, an electromagnetic valve drive circuit and a solenoid microvalve drive circuit which are linked to I/O interface of the MCU to drive the electromagnetic valves and the solenoid microvalve.

Said MCU may further comprises an analog to digital conversion unit to receive measurements from said pressure sensors.

The benefits of present invention include convenience for sampling and washing between samples as the robotic arm can carry the micro-dispensing unit into wells on microplate where liquid samples are stored prior to distribution for aspirating sample into the dispensing unit by negative pressure. The aspirating and dispensing volume are easily adjusted by changing the pressure magnitude and time duration that the microvalve is kept open. The minimum dispensing volume of the system can be 2 nL when 15% Glycerol used as sample.

The pressure adjusting unit is simple and can be implemented by many ways. The pressure adjusting unit has highly precise control on pressure via highly precise pressure sensors and pressure regulating valves. It is convenient to regulate the pressure regulating, and there is no need to retune the pressure during dispensing. High consistency of dispensing volume is achieved due to sub-millisecond level response time and instantaneous opening of the solenoid microvalve. When 10 nL dispensing volume is applied, variation is lower than 4%. The system has wide range of controllable dispensing volume from several nanoliter to several dozens of microliter to meet the requirements for various circumstances involving small volume liquid operation such as microarray fabrication, liquid distribution and transfer, etc. Sample waste is minimized by expiring remaining sample to the original vessel after dispensing operation.

PREFERRED EMBODIMENTS OF THE INVENTION

Below is a further illustration of the invention in connection with the drawings.

Figure 1:
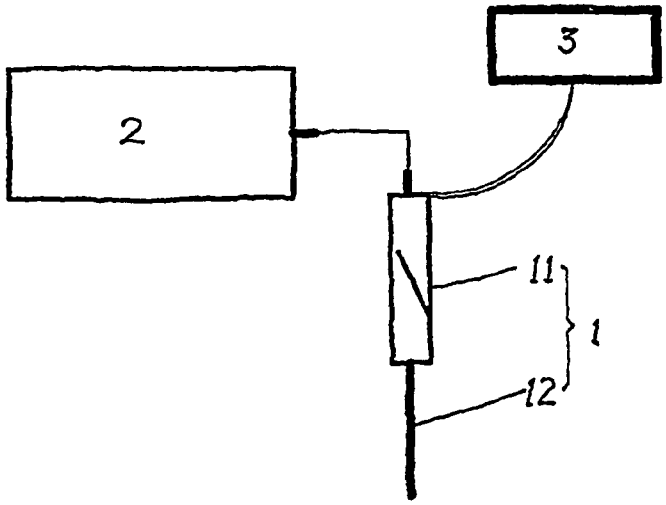
FIG. 1 is a schematic diagram of the system of the invention.

As shown in FIG. 1, the invention may consist of a micro-dispensing unit 1, a pneumatic module 2 and an electric control circuit 3. The micro-dispensing unit 1 and the pneumatic module 2 are connected with a conduit. The micro-dispensing unit 1 may consist of a solenoid electromagnetic microvalve 11 and a micro dispenser 12, which are connected with a conduit. The micro-dispensing unit could be one or more. The micro-dispensing unit 1 could be connected to a robotic arm and moved by the robotic arm to different positions for microarray fabrication following a preset program. One or more micro-dispensing units are pressurized by the common pneumatic module 2.

The pneumatic module 2 may take several forms in structure. Some embodiments are described as below.

Figure 2:
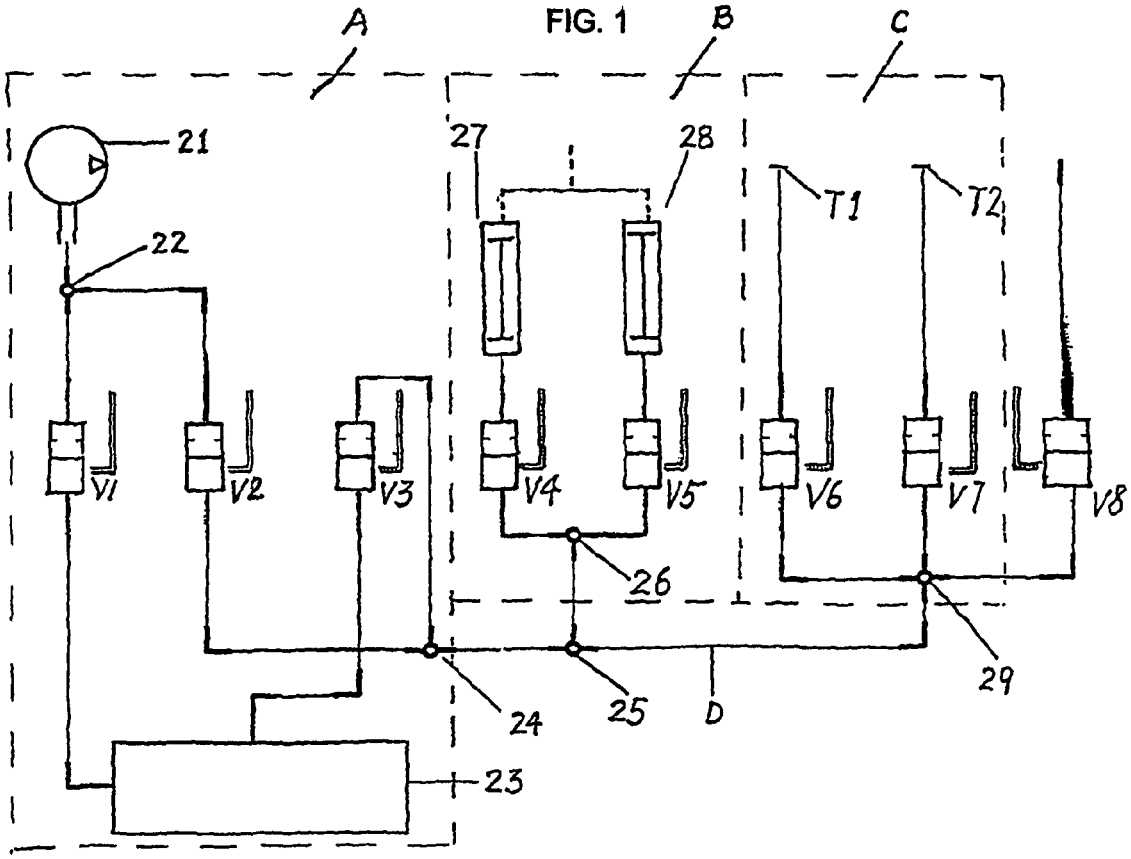
FIG. 2 is a schematic diagram of the pneumatic module of the invention.
Figure 3:
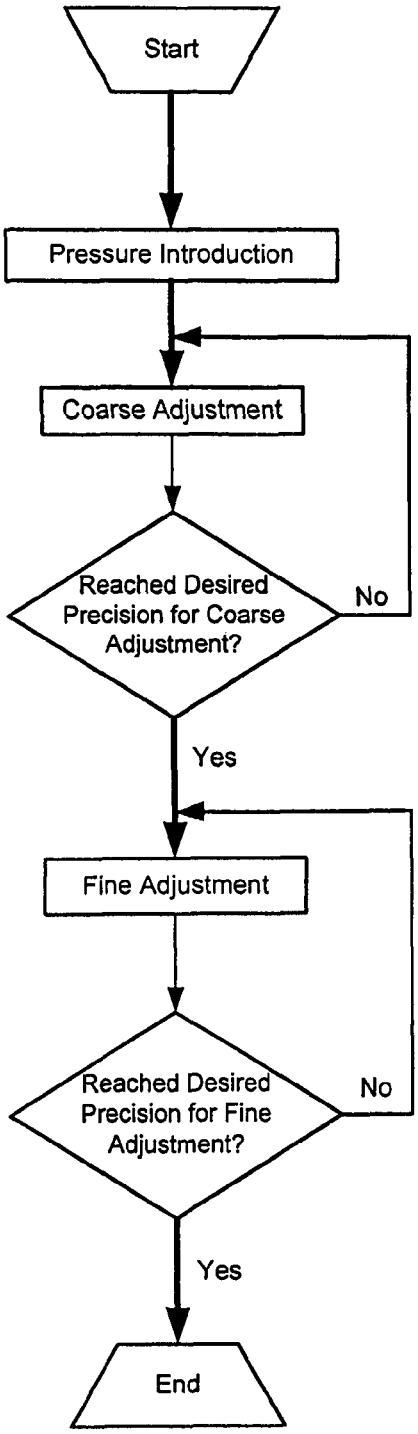
FIG. 3 is a flowchart of pressure generating process of the invention.

Embodiment 1:

As shown in FIG. 2, in this particular embodiment, the pneumatic module 2 includes: pneumatic pressure generating unit A, pressure sensor unit B, pressure adjusting unit C, and pressure delivery conduit D which connects unit A, B, C and the micro-dispensing unit 1. Pneumatic pressure generating unit A includes an air compressor 21, a three way adaptor 22 connected to the outlet of air compressor 21, two way electromagnetic valve V1 and V2 connected to the three way adaptor 22, a vacuum generator 23, the inlet of which is connected to electromagnetic valve V1, a two way electromagnetic valve V3 connected to the outlet of the vacuum generator 23, a three way adaptor 24 connected to electromagnetic valve V2 and V3, pressure delivery conduit D connected to the three way adaptor 24 and further connected with pressure sensor unit B. Pressure sensor unit B includes a three way adaptor 25 connected to pressure delivery conduit D, another three way adaptor 26 connected to the three way adaptor 25, electromagnetic valve V4 and V5 connected to the three way adaptor 26, a positive pressure sensor 27 and a negative pressure sensor 28 connected to the electromagnetic valve V4 and V5 respectively and communicating with the control circuit 3. Pressure adjusting unit C is connected to the pressure delivery conduit D downstream of the pressure sensor unit B. The pressure adjusting unit C includes a four way adaptor 29 connected to the pressure delivery conduit D, two way electromagnetic valves V6 and V7 connected to the four way adaptor 29, flow regulating valve T1 and T2 with different preset flow volume for coarse/fine adjustment on pressure and connected to electromagnetic V6 and V7 respectively. An electromagnetic valve V8 connects the outlet of pressure delivery conduit D and the micro-dispensing unit 1.

In the embodiment, control circuit 3 receives pressure measurements from sensor 27 and 28, calculates the difference between desired parameters and actual measurements of pressure, and conducts coarse and fine adjustment on pressure. Detailed description is provided as below (See, for example, FIG. 2 and FIG. 6):

(1) Generate Negative Pressure

First, electromagnetic valve V1 and V3 are switched on, positive pressure is transmitted through valve V1 from air compressor 21 to the inlet of vacuum generator 23, and negative pressure from the outlet of the vacuum generator 23 through valve V3 is transmitted to the pressure delivery conduit D. Then, valve V5 which is connected to negative sensor 28 is switched on, the actual pressure in the pressure delivery conduit D is measured from sensor 28. If the actual pressure is higher than the preset value, valve V1 and V3 are switched on again to lower the pressure in pressure delivery conduit D. If the actual pressure is lower than the preset value, electromagnetic valve V6 is switched on for a very short period of time to allow some air from atmosphere into the pressure delivery conduit D to increase the pressure until the difference between actual and desired value falls within the precision tolerance of coarse adjustment. After that, the electromagnetic valve V8 is switched on to allow the pressure from pneumatic module 2 into the conduit connecting to the solenoid microvalve II of the micro-dispensing unit 1. The actual pressure is measured again with the negative pressure sensor 28, and then fine adjustment is done with electromagnetic valve V1, V3 and V7 by procedures similar to the coarse adjustment.

(2) Generate Positive Pressure

The process to generate positive pressure is similar to the process to generate negative pressure. The difference is that two-way electromagnetic valve V2 is switched on, directly delivering positive pressure into the pressure delivery conduit D. Then, the two way electromagnetic valve V4 is switched on, and the positive pressure sensor 27 is used to measure the actual pressure in the pressure delivery conduit D. If actual measurement is lower than the preset value, valve V2 is switched on to increase the pressure; and if it is higher, coarse and fine adjustment are conducted by switching on electromagnetic valve V6 and V7.

During the entire procedure of pressure adjustment, the solenoid microvalve 11 should be turned off. The status of each two way electromagnetic valve during the above-described procedures are shown in Table 1.

TABLE 1

| Operation | Electromagnetic Valve V1 | V2 | V3 | V4 | V5 | V6 | V7 | V8 | Microvalve of micro-dispensing unit |
|---|---|---|---|---|---|---|---|---|---|
| Introducing Positive Pressure | Off | On | Off | Off | Off | Off | Off | Off | Off |
| Positive Pressure Coarse Adjustment | Off | Off | Off | On | Off | On | Off | Off | Off |
| Positive Pressure Fine Adjustment | Off | Off | Off | On | Off | Off | On | On | Off |
| Introducing Negative Pressure | On | Off | On | Off | Off | Off | Off | Off | Off |
| Negative Pressure Coarse Adjustment | Off | Off | Off | Off | On | On | Off | Off | Off |
| Negative Pressure Fine Adjustment | Off | Off | Off | Off | On | Off | On | On | Off |
| Liquid Dispensing/ Aspirating | Off | Off | Off | Off | Off | Off | Off | On | On |
| Waiting | Off | Off | Off | Off | Off | Off | Off | Off | Off |

Note:
"On" means open status;
"Off" means closed status.

Figure 4:
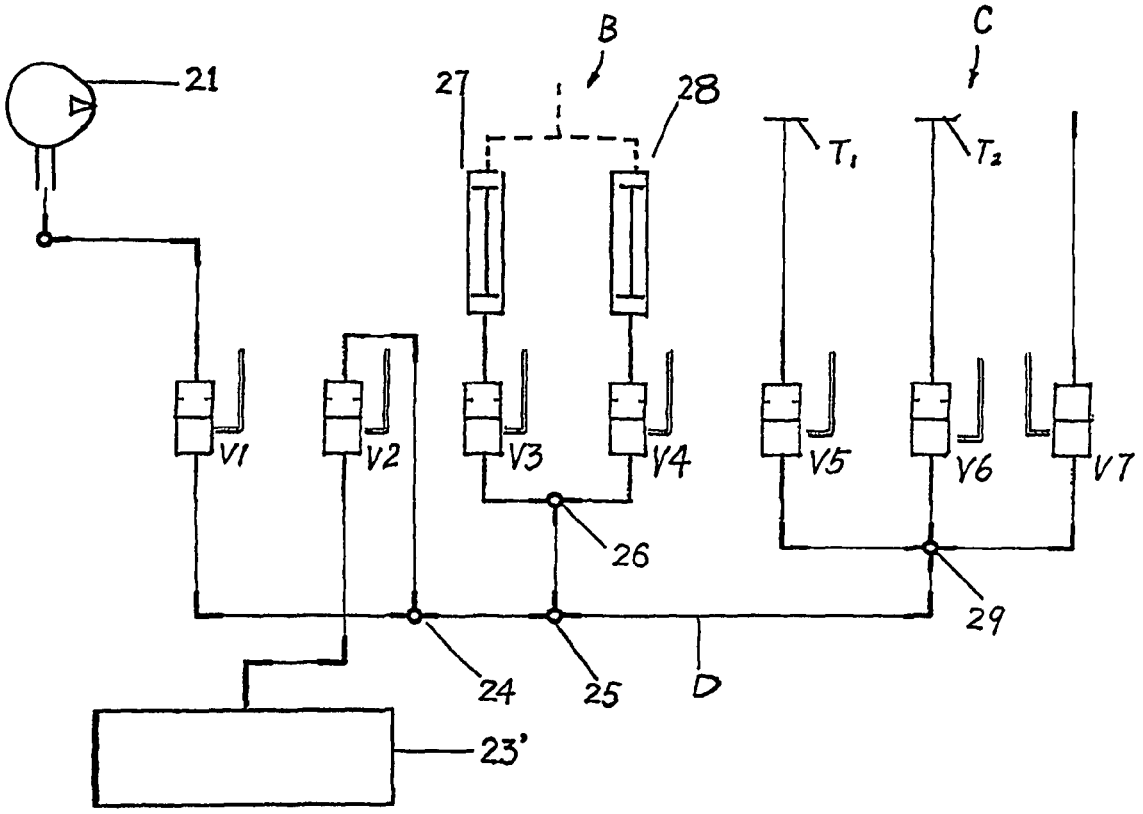
FIG. 4 is a schematic diagram of the pneumatic module in an another embodiment of the invention.

Embodiment 2:

As shown in FIG. 4, in this embodiment, the configurations of pressure sensor unit B, pressure adjustment unit C and pressure delivery conduit D of the pneumatic module 2 are the same as in the embodiment 1, but pneumatic pressure generating unit A is different. In this embodiment, the air compressor 21 is used for positive pressure of pneumatic pressure generating unit, but the vacuum generator 23 is substituted by a vacuum pump 23'. The air compressor 21 and the vacuum pump 23' are connected to electromagnetic valve V2 and V3 respectively, and the outlets of the electromagnetic valve V2 and V5 connected to the pressure delivery conduit D via the three way adapter 24. The other end of the three way adapter 24 is connected to the pressure delivery conduit D. Other details are the same as the embodiment 1, and thus are not described again.

To operate, the vacuum pump 23' and the electromagnetic valve V3 are switched on, and the negative pressure is delivered directly into the pressure delivery conduit D. The air compressor 21 and the electromagnetic valve V2 are switched on, and the positive pressure is delivered directly into the pressure delivery conduit D. Similar method is applied to monitor and adjust pneumatic pressure in both embodiment 1 and 2, and is not described again.

Figure 5:
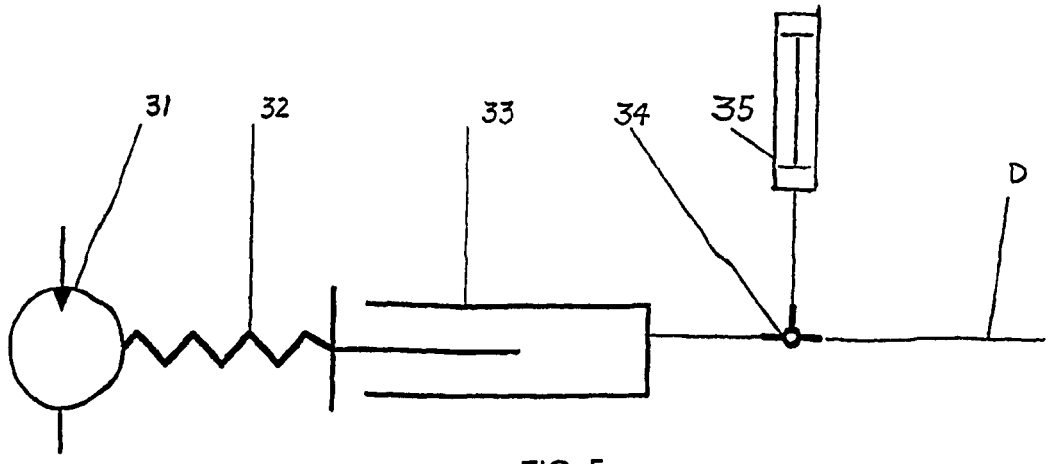
FIG. 5 is a schematic diagram of the pneumatic module in an another embodiment of the invention.

Embodiment 3:

As shown in FIG. 5, in this embodiment, the pneumatic module 2 takes the form of syringe pump. It includes: a step motor 31, a linear motion unit 32 with threaded spindle connected to the outlet of the step motor 31, a syringe 33 in which a plunger is connected with the linear motion unit 32, a pressure delivery conduit D connected to the outlet of the syringe 33, a positive/negative pressure sensor 35 is connected to the path of the pressure conduit D via a three way adaptor 34. In embodiment 1 and embodiment 2, positive/negative pressure sensor 35 can be used to substitute the positive pressure sensor 27 and the negative pressure sensor 28. In the present embodiment, the positive sensor 27 and the negative pressure sensor 28 can be used to substitute the positive/negative pressure sensor 35. The positive/negative pressure sensor 35 could measure both positive and negative pressure. The solenoid electromagnetic microvalve 11 of the micro-dispensing unit 1 is connected to the pressure delivery conduit D. The linear motion unit 32 in this embodiment could be implemented by various structures as long as it could control forward and backward movement of the plunger in the syringe 33.

In this embodiment, the positive/negative pressure sensor 35 monitors the pressure in the pressure delivery conduit D in real time manner. When a desired pressure is required, the microvalve 11 of the micro-dispensing unit 1 is switched off, and the plunger in the syringe 33 is pushed by the linear motion unit 32 and the step motor 31.to decrease the conduit volume to generate positive pressure; or the plunger in the syringe 33 is pulled by the linear motion unit 32 and the step motor 31 to increase the conduit volume to generate positive pressure. The control circuit 3 receives pressure measurements from the positive/negative pressure sensor 34 to adjust the pressure in the conduit until it is within the precision requirements. In order to adjust the pressure, the measurements from the positive/negative pressure sensor 34 feed back to the control circuit 3, and then the control circuit 3 drives the step motor 31 to bring small displacement to the linear motion unit 32 to change the conduit volume slightly.

Figure 6:
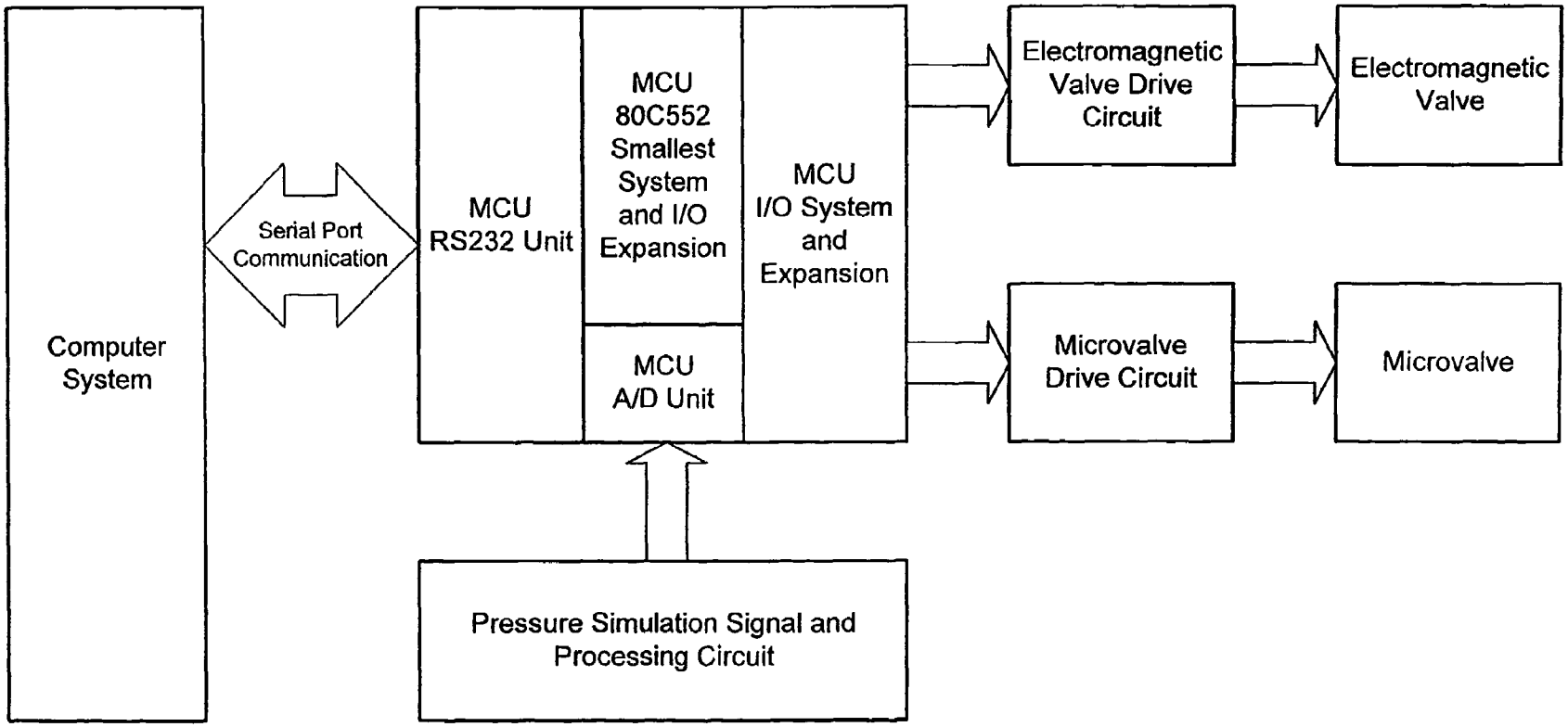
FIG. 6 is a schematic diagram of the electrical control circuit of the invention.

As shown in FIG. 6, the control circuit 3 of the invention may comprise a micro control unit (MCU). In this embodiment, it is model 80C552, implemented with analog to digital (A/D) conversion unit, RS232 serial port and I/O port. The pressure measurements from the pressure sensor(s) of pneumatic module 2 are received by the MCU via A/D conversion unit. The MCU communicates with PC host via RS232 serial port. The PC host is implemented with software program. MCU executes instructions sent from the PC host, and sends feedback to the PC host with the consequence of the execution, and measurements from the pressure sensors. MCU executes the instructions from PC host via its I/O ports connected to corresponding driver circuits of electromagnetic valves or solenoid microvalves to switch the electromagnetic valves and the solenoid microvalves on or off. The liquid volume to be aspirated or dispensed is controlled by the control circuit 3 via adjustment on pneumatic pressure or the time duration in which the solenoid microvalve is switched on. Increase of the absolute value of the pressure or elongation of time duration brings increase on the volume to be aspirated or dispensed. the volume is decreased is the opposite is used.

In this invention, the micro-dispensing unit 1 could be mounted on a robotic arm, and the action of the robotic arm could be administrated by particular motion control card. The control of all actions of the robotic arm and the micro-dispensing modules could be integrated into a single software program. Parameters and instructions are transmitted through serial port between the program and the control circuit 3. The program implements the cooperation of pressure preparation, aspiration, dispensing operations and robotic arm actions, to automate the process consisting of sampling from vessels, spotting on the slides to fabricate microarray and washing the conduit.

Figure 7:
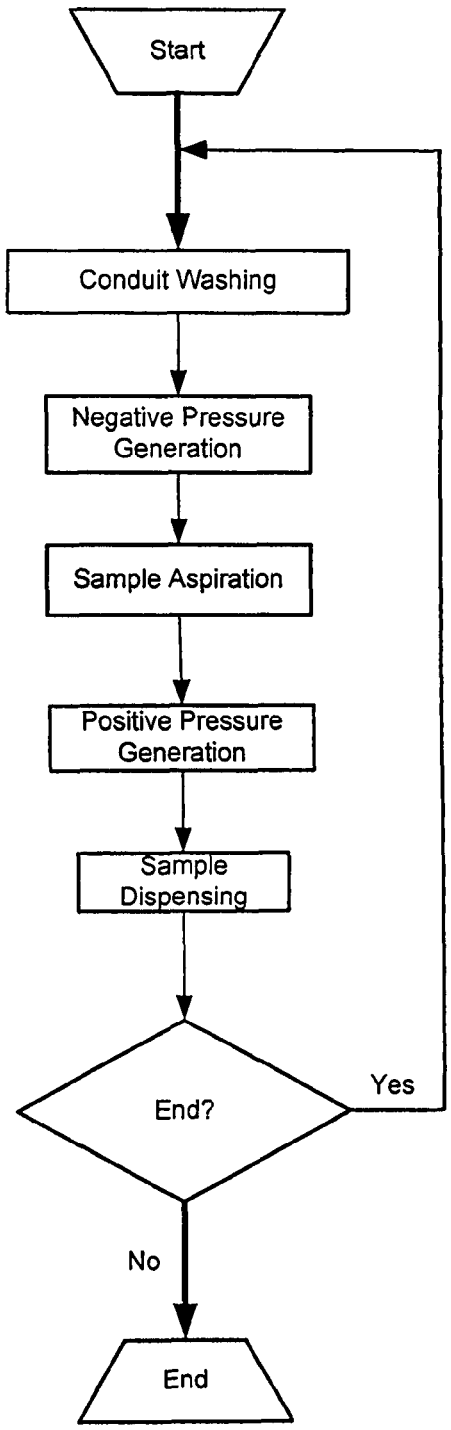
FIG. 7 is a flowchart illustration of the dispensing operation of the invention.

The flow through of the invention could be described as following (See FIG. 7):

(1) Aspiration

Negative pressure is introduced to the conduit within the precision tolerance of the desired value. The micro-dispensing unit 1 is brought to the sample source location by the robotic arm, and the micro-dispenser 12 is inserted into the sample liquid. The solenoid microvalve 11 is opened to set the time. The liquid is aspirated into the conduit. The aspiration volume is dependent upon the time span during which the solenoid microvalve is kept opening, amplitude of negative pressure in the conduit, volume of the conduit and viscosity of the liquid. To prevent the air bubble entering the conduit, the sample should be defoamed prior to aspiration, and the negative pressure should not be too low.

(2) Dispensing

Positive pressure is introduced to the conduit within the precision tolerance of the desired value. The micro-dispensing unit 1 is carried by the robotic arm to a location just above the microarray slide to be spotted. The solenoid microvalve 11 is opened to dispense a tiny droplet of liquid from the dispenser 12 to the slide within a very short period of time. Then, the micro-dispensing unit 1 is moved to another location on the slide to dispense another droplet when the solenoid microvalve 11 is opened. The process above, carrying the micro-dispensing unit 1 with the robotic arm to a location and opening the solenoid microvalve 11 to dispense droplet to the slide, is repeated to spot equal aliquots of sample onto the slides. The software program and control circuit may be used to optimize the arrangement of parallel action of the micro-dispensing unit 1 and the solenoid microvalve 11 to improve the efficiency.

(3) Washing the Micro-Dispensing Conduit

It is necessary to wash the micro-dispensing conduits at the beginning and the end of every dispensing operation for different sample, such as inner chamber of solenoid microvalve 11 and the micro-dispenser 12, the conduit connecting them and other sections where the sample fluid flow through. The washing process is multiple repetitions of said aspiration and dispensing process, i.e., to aspirate and dispense the washing buffer repeatedly. To improve efficiency, the solenoid microvalve is opened once to dispense the entire washing buffer in bulk, instead of being opened for multiple instants to form continual droplets.

After washing the conduit, the positive pressure and opening the solenoid microvalve 11 process is repeated to expel the remaining air bubbles and washing buffer, to ensure that the next sample is not diluted or impaired by bubbles on dispensing consistency.

Generally, the invention fulfils the purpose to aspirate samples from 96/386 well microplates directly instead of the necessity of other vessels, to shift between processes handling different samples and perform washing procedure automatically and conveniently with simplicity, to control the volume to be dispensed by adjusting the pneumatic pressure generated by the pneumatic module 2 and the time span during which solenoid microvalve 11 keeps opening, to overcome the disadvantages in the prior art such as exaggerated requirement on sample volume, difficulties to wash between samples, wastage of samples and inability to tune the pressure in real time mode when dispensing.

In addition for use in the fabrication of microarray, the invention may be used for small volume liquid transferring and handling, such as quantitative liquid transfer from 96 well microplate containing different sample to 386 well microplate or from one 384 well microplate to another 384 well microplate, or liquid transfer for the same sample from 96 well microplate to 386 well microplate.

In addition for use in transfer and handling of biological fluids such as trace mount DNA solution, the invention may be used for transfer and handling other types of liquids, such as in the process of fabrication of circuit board. The invention may be used to dispense small droplet of insulated fluidic material on specific locations over circuit board.

Industrial Use

The invention may be conveniently used for dispensing thousands of samples onto a microarray substrate in connection with a robotic arm with automatic sample collection, sample dispensing and conduit washing. The invention can be widely used for transferring or dispensing liquid, including biological liquid, in nL and μL volume range.

The invention claimed is:

1. A micro-volume liquid dispensing system comprising:

(a) a pneumatic module, wherein the pneumatic module comprises:

a pressure delivery conduit;

a pneumatic pressure generating unit connected to the inlet of the pressure delivery conduit; and a pressure sensor unit and a pressure adjusting unit, which are connected to the pressure delivery conduit sequentially and separate from the pressure generating unit;

(b) a micro-dispensing unit connected to the pneumatic module with the pressure delivery conduit; and (c) an electric control circuit for controlling the pneumatic module and the micro-dispensing unit, wherein:

the pneumatic pressure generating unit comprises two parallel electromagnetic valves connected to the inlet of the pressure delivery conduit, and an air compressor and a vacuum pump connected to the two electromagnetic valves respectively;

the pressure sensor unit comprises two parallel electromagnetic valves connected to the pressure delivery conduit, and a positive and a negative pressure sensor connected to the two electromagnetic valves respectively; and the pressure adjusting unit comprises two parallel electromagnetic valves connected to the pressure delivery conduit, and coarse and fine regulating valves connected to the two electromagnetic valves respectively.

2. A micro-volume liquid dispensing system comprising:

(a) a pneumatic module, wherein the pneumatic module comprises:

a pressure delivery conduit;

a pneumatic pressure generating unit connected to the inlet of the pressure delivery conduit; and a pressure sensor unit and a pressure adjusting unit, which are connected to the pressure delivery conduit sequentially and separate from the pressure generating unit;

(b) a micro-dispensing unit connected to the pneumatic module with the pressure delivery conduit; and (c) an electric control circuit for controlling the pneumatic module and the micro-dispensing unit, wherein:

the pneumatic pressure generating unit comprises an air compressor, two parallel electromagnetic valves connected to the outlet of the air compressor, a vacuum generator and an additional electromagnetic valve in tandem between one of the two electromagnetic valves and the inlet of the pressure delivery conduit;

the pressure sensor unit comprises two parallel electromagnetic valves connected to the pressure delivery conduit, and a positive and a negative pressure sensor connected to the two electromagnetic valves respectively; and the pressure adjusting unit comprises two parallel electromagnetic valves connected to the pressure delivery conduit, and coarse and fine regulating valves connected to the two electromagnetic valves respectively.

3. The micro-volume liquid dispensing system of claim 1 or 2, wherein the control circuit comprises a computer, a MCU communicating with the computer via a serial port, an electromagnetic valve drive circuit and a microvalve drive circuit which are linked to I/O interface of the MCU to drive the electromagnetic valves.

4. The apparatus of claim 3, wherein the MCU comprises an analog to digital conversion unit to receive measurements from the pressure sensor unit.

* * * * *